US011553272B2

(12) United States Patent
Coote et al.

(10) Patent No.: US 11,553,272 B2
(45) Date of Patent: Jan. 10, 2023

(54) LOUDSPEAKER WITH MECHANICAL RESONANCE MITIGATION

(71) Applicant: Paradigm Electronics Inc., Mississauga (CA)

(72) Inventors: Doug Coote, Brampton (CA); Scott Bagby, Mississauga (CA); Oleg Bogdanov, Toronto (CA)

(73) Assignee: Paradigm Electronics Inc., Mississauga (CA)

( * ) Notice: Subject to any disclaimer, the term of this patent is extended or adjusted under 35 U.S.C. 154(b) by 0 days.

(21) Appl. No.: 17/039,374

(22) Filed: Sep. 30, 2020

(65) Prior Publication Data

US 2022/0103935 A1 Mar. 31, 2022

(51) Int. Cl.
*H04R 9/04* (2006.01)
*H04R 1/28* (2006.01)

(52) U.S. Cl.
CPC ..... *H04R 1/2834* (2013.01)

(58) Field of Classification Search
CPC ..... H04R 9/00; H04R 29/003
USPC ..... 381/398, 404
See application file for complete search history.

(56) References Cited

U.S. PATENT DOCUMENTS 2,371,951 A 3/1945 Cook
3,350,513 A 10/1967 Roberts
4,118,605 A * 10/1978 Kobayashi ..... H04R 9/045 381/407
4,122,314 A * 10/1978 Matsuda ..... H04R 7/02 181/170
5,734,734 A * 3/1998 Proni ..... H04R 9/02 381/432
6,343,136 B2 * 1/2002 Tokusho ..... H04R 9/06 181/171
6,621,912 B2 * 9/2003 Sugiyama ..... H04R 9/04 381/407
6,842,529 B2 * 1/2005 Koura ..... H04R 9/04 381/403
7,394,913 B2 * 7/2008 Matsuda ..... H04R 9/041 381/407
7,760,901 B2 * 7/2010 Kaiya ..... H04R 31/006 381/396
7,844,071 B2 * 11/2010 Funahashi ..... H04R 31/006 381/396
7,970,162 B2 * 6/2011 Sumitani ..... H04R 31/006 381/407
9,774,972 B2 * 9/2017 Ilkorur ..... H04R 9/025
2001/0043713 A1 * 11/2001 Tokusho ..... H04R 9/06 381/407
2003/0002702 A1 * 1/2003 Cox ..... H04R 1/025 381/340

OTHER PUBLICATIONS

Audio Engineering Society Publication entitled Theory Numerical Calculation of the Vibration and Sound Radiation of Cone and Dome Loudspeakers With Non-Rigid Diaphragms by A.J.M. Kaizer, Philips Research Laboratories, Reprint No. 1437 (D-1) (1979) (pp. 2-27).

(Continued)

*Primary Examiner* — Suhan Ni
(74) *Attorney, Agent, or Firm* — Hovey Williams LLP

(57) ABSTRACT

A loudspeaker driver moving system including a bobbin, a diaphragm and an elastic damping ring interposed between and attached respectively to the bobbin and the diaphragm.

18 Claims, 7 Drawing Sheets

(56) References Cited

OTHER PUBLICATIONS

Audio Engineering Society Publication entitled Design Parameters and Trade-Offs in Large Diameter Transducers by Douglas J. Button, JBL/;Harman Speaker Manufacturing 3192 (G-2)(1991) (pp. 2-82).

* cited by examiner

LOUDSPEAKER WITH MECHANICAL RESONANCE MITIGATION

BACKGROUND

A loudspeaker includes a one or more drivers. The driver is configured to generate sound in a frequency range. For example, the loudspeaker may include a driver that is configured to generate sound ranging from approximately 50 Hz to approximately 10,000 Hz. The driver includes a diaphragm that moves to generate sound waves, and a voice coil that oscillates to move the diaphragm. Performance of the loudspeaker may vary across the frequency range. For example, in portion(s) of the loudspeaker's range resonant behavior may lead to a decrease in sound quality. The portion(s) of the range in which appreciable resonant behavior occurs may vary depending, for example, on geometry of the diaphragm and its material properties.

SUMMARY OF THE INVENTION

Embodiments of the current invention provide a distinct advance in the art of loudspeaker design. Specifically, embodiments of the current invention provide a loudspeaker with mechanical resonance mitigation, increasing sound quality over frequency ranges traditionally negatively impacted by such resonance.

In one or more embodiments, a loudspeaker driver has a moving structure, the moving structure including a bobbin, a diaphragm, and an elastic damping ring interposed between and attached respectively to the bobbin and the diaphragm.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figures 6, 7:
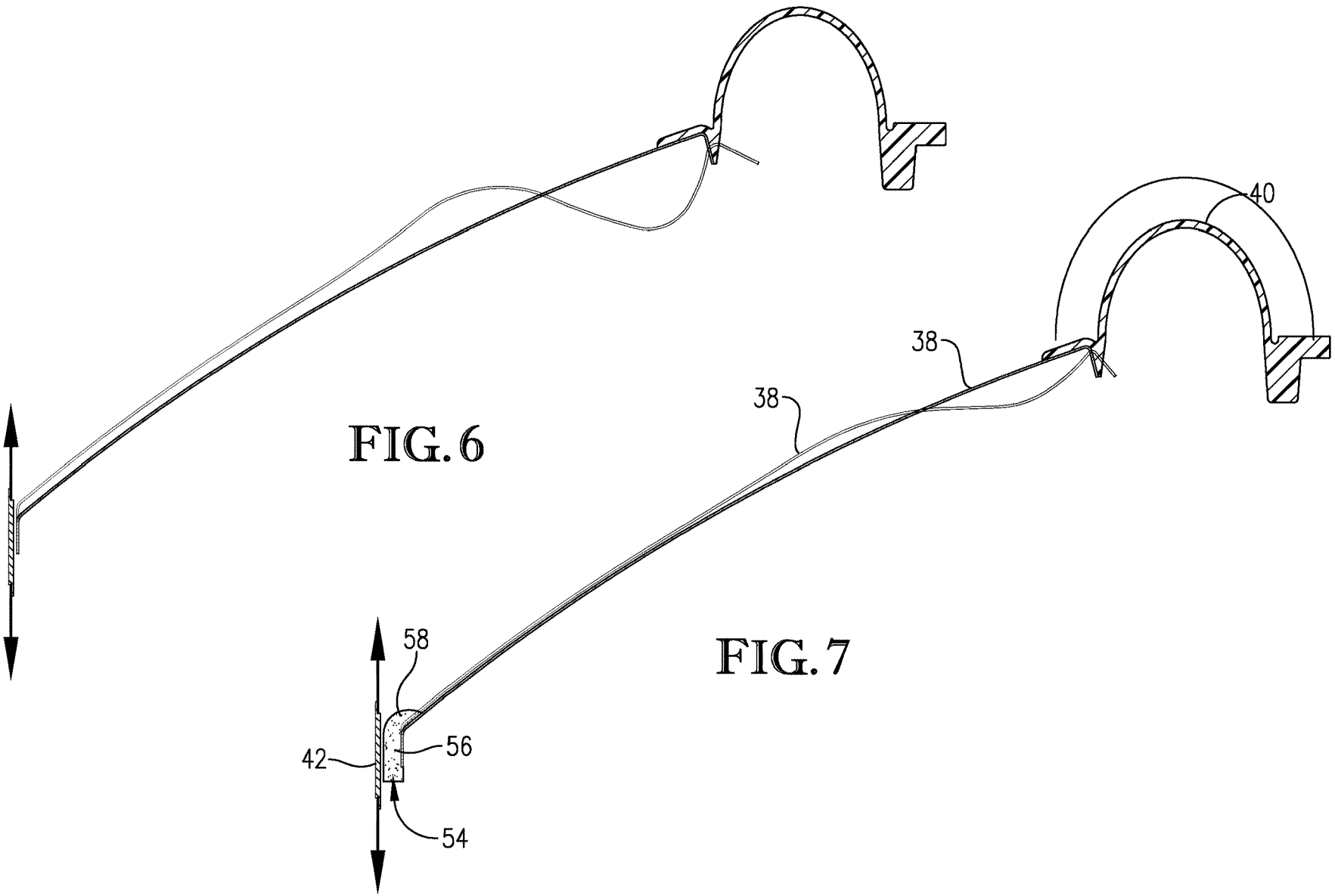
FIG. 6 is a partial cross-sectional side view of a loudspeaker without an elastic damping ring, a diaphragm of the loudspeaker being attached directly to a bobbin via adhesive and exhibiting substantial resonant behavior.
Figure 8:
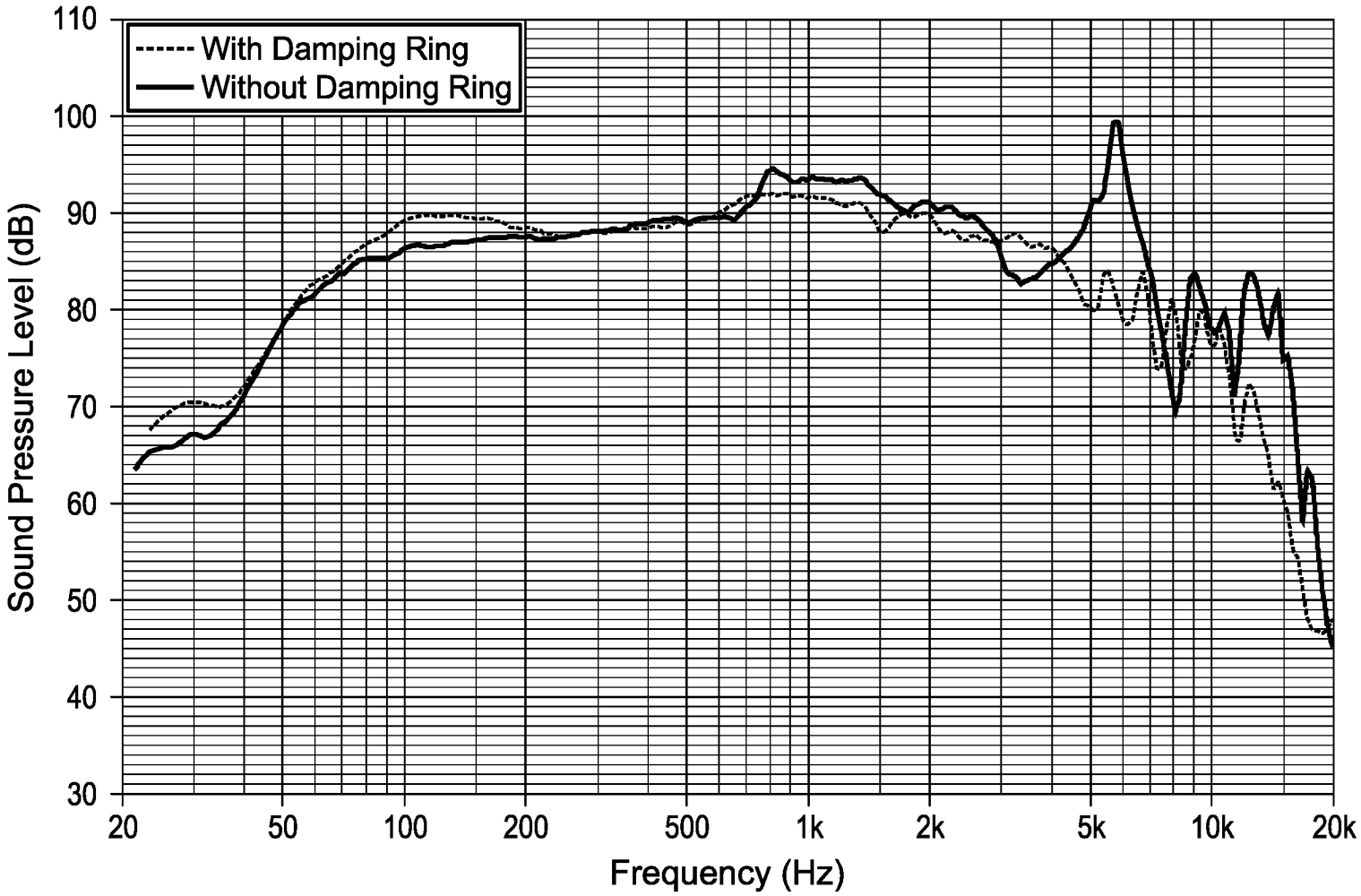

FIG. 7 is a partial cross-sectional side view of a loudspeaker according to embodiments of the present invention, a diaphragm of the loudspeaker being attached to an elastic damping ring, the elastic damping ring being attached to a bobbin, and the diaphragm exhibiting mitigated resonant behavior; and FIG. 8 is a graph of Sounds Pressure Level (dB) vs. Frequency (Hz) comparing resonant behaviors between the loudspeakers partially illustrated in FIGS. 6 and 7.

The drawing figures do not limit the current invention to the specific embodiments disclosed and described herein. While the drawings do not necessarily provide exact dimensions or tolerances for the illustrated components or structures, the drawings are to scale as examples of certain embodiments with respect to the relationships between the components of the structures illustrated in the drawings.

DETAILED DESCRIPTION OF THE EMBODIMENTS

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

A loudspeaker driver 10, constructed in accordance with various embodiments of the current invention, is shown in FIGS. 1-5 and 7 and broadly comprises a static structure 12 and a moving system 14 mounted on the static structure 12. The components of the loudspeaker driver 10 are generally centered on a central axis 20, and the moving system 14 is mounted on the static structure 12 and configured for oscillation along the central axis 20. The static structure 12 provides structural support to retain the components of the moving system 14 and a magnetic circuit 18.

The static structure 12 includes a basket 22, a back plate 23, pole piece 24, a top plate 25 and first and second magnets 26, 28. The basket 22 includes first, second, and third rings 30, 32, 34, each being centered on the axis 20. The first ring 30 has a first radially-inner diameter and a first radially-outer diameter. The second ring 32 is radially outside of and axially spaced from the first ring 30 and has a second radially-inner diameter and a second radially-outer diameter. The second inner diameter is greater than the first outer diameter. The third ring 34 is radially outside of and axially spaced from the second ring 32. The third ring 34 has a third radially-inner diameter and a third radially-outer diameter. The third inner diameter is greater than the second outer diameter. One of ordinary skill will appreciate that relative dimensions of basket rings described herein are merely exemplary and may be otherwise configured without departing from the spirit of the present invention.

A plurality of first spokes 36, radially oriented and circumferentially spaced, connect the first ring 30 to the second ring 32. A plurality of second spokes 37, radially oriented and circumferentially spaced, connect the first, second and third rings 30, 32, 34 to one another. The back plate 23, pole piece 24 and top plate 25 may be formed from magnetically permeable or "soft" material, such as low carbon steel.

The top plate 25 is disc-shaped. The top plate 25 may be coupled to the first ring 30 to removably or permanently couple or assemble the back plate 23, pole piece 24 and top plate 25 to the basket 22. Upon assembly, an axially-forward surface of the top plate 25 may be adjacent to and/or flush against an axially-rearward surface of the first ring 30.

The moving system 14 includes a diaphragm 38, a surround 40, a bobbin 42, a spider 44, and a voice coil 46. The diaphragm 38 is generally frustoconical or, in one or more embodiments, conical or dome-shaped. The diaphragm 38 includes a circumferentially-extending radially-inner edge and a circumferentially-extending radially-outer edge. The diaphragm 38 may be formed from rigid or semi-rigid materials, such as paper, polymers such as polypropylene or Mylar, or metals such as aluminum, magnesium and/or alloys and/or composite materials of the foregoing.

The surround 40 is generally annular and includes a circumferentially-extending radially-inner edge and a circumferentially-extending radially-outer edge. The surround 40 is connected (e.g., rigidly) to the diaphragm 38 with the radially-inner edge of the surround 40 being adjacent the radially-outer edge of the diaphragm 38. The surround 40 is also connected (e.g., rigidly) to the third ring 34 with the radially-outer edge of the surround 40 being adjacent the third ring 34. The surround 40 may be formed from flexible materials.

The spider 44 is generally annular and includes a circumferentially-extending radially-inner edge. The spider 44 is connected to the bobbin 42 with the radially-inner edge of the spider 44 adjacent and/or connected to the bobbin 42. The spider 44 also includes a circumferentially-extending radially-outer edge. The spider 44 may be connected to the second ring 32 with the radially-outer edge of the spider 44 being adjacent and/or connected to the second ring 32.

The spider 44 may comprise semi-rigid or flexible materials. Between radially-inner and -outer edges, the spider 44 may form or present a plurality of radially-spaced waves, ripples, or corrugations.

The voice coil 46 includes a plurality of windings of electrically-conductive wire in a helical shape similar to a solenoid, wherein the wire is formed from copper, aluminum, or other metals or metal alloys. The wire may have a generally circular, generally square or rectangular, generally hexagonal, or other geometric cross-sectional shape. The voice coil 46 is wrapped around, or mounted on, the bobbin 42 and is positioned so that at least a portion of the windings is in contact with, and is fixed to, an outer surface of the bobbin 42, near its axially-rearward edge. Motion of the voice coil 46 results in, or causes, motion of the bobbin 42 and, through structure discussed in more detail below, of the diaphragm 38.

Moreover, the spider 44 generally circumscribes the bobbin 42, preferably providing a relatively evenly-distributed radially-inward force that tends to center the bobbin 42 and reduce radial motion of the voice coil 46 while allowing axial motion. Similarly, the surround 40 generally reduces or eliminates radial motion of the diaphragm 38 while allowing axial motion.

The moving system 14 also includes a cap 50 (e.g., dust cap). The cap 50 has a partial spherical or paraboloid shape and includes a circumferentially-extending radially-outer edge. The cap 50 may be formed from rigid or semi-rigid materials. The cap 50 provides a protective cover for the axially-rearward components of the loudspeaker driver 10. The cap 50 may be attached (e.g., rigidly) to the diaphragm 38.

The magnetic circuit 18 provides a magnetic field through which the voice coil 46 moves. The magnetic circuit 18 includes first magnet 26, second magnet 28, and portions of the back plate 23, pole piece 24 and top plate 25. The back plate 23, pole piece 24 and top plate 25 may be formed from magnetically permeable material.

The first magnet 26 and the second magnet 28 are each permanent magnets having a ring or annular shape and roughly the same dimensions, including inner diameter, outer diameter, and axial length or thickness. The first magnet 26 is positioned in contact with the back plate 23. The top plate 25 is positioned such that a lower or axially-rearward surface of the top plate 25 is in contact with, and connected to, an upper or axially-forward surface of the second magnet 28. The top plate 25 may be attached to the second magnet 28, and the back plate 23 may be attached to the first magnet 26, using fasteners, adhesives or the like.

The pole piece 24 is fixed to or integral with the back plate 23, and presents a cylindrical, axially-extending, radially outer margin or surface. In one or more embodiments, the pole piece 24 is solid. One of ordinary skill will also appreciate that a pole piece also or alternatively presents a semi-elliptical, arcuate, or rounded inner surface according to embodiments of the present invention. The pole piece 24 is positioned radially inside of the bobbin 42 and a radially-inner diameter of the top plate 25.

In addition, there is a magnetic gap 52 between the radially-outer surface of the pole piece 24 and the radially-inner surface of the top plate 25. The voice coil 46 is positioned in the magnetic gap 52.

The first magnet 26 generates a first magnetic field, and the second magnet 28 generates a second magnetic field. The lines of magnetic flux of the two magnetic fields are mostly contained within the magnetic circuit 18. That is, magnetic flux lines generated from the south magnetic poles of the two magnets 26, 28 flow into the back plate 23 and the pole piece 24. Magnetic flux lines flow across the magnetic gap 52, through the voice coil 46, into the top plate 25, and to the north magnetic pole of the second magnet 28.

The loudspeaker driver 10 may operate as follows. An audio electronic signal is provided to the loudspeaker driver 10. The audio signal is communicated to the voice coil 46. The voice coil 46 is positioned within the magnetic gap 52, through which magnetic field lines flow. Electric currents flowing through the voice coil 46 cause mechanical forces to be exerted on the voice coil 46, transverse to the flow of the magnetic field lines. The forces cause the voice coil 46 to move axially. As the electric currents change direction of flow according to the waveform of the audio signals, the voice coil 46 oscillates axially. Motion of the voice coil 46 causes motion of the diaphragm 38 which generates the sound output of the loudspeaker driver 10.

Typically, a loudspeaker's diaphragm is glued directly to a body of a collar or bobbin, the collar or bobbin having a rigid body and being secured to a voice coil. Movement of the rigid body with the voice coil in response to electrical signals is transferred to the diaphragm across cured epoxy, cyanoacrylate or other adhesive. The glues or adhesives that serve as the medium for such transferal of force from the rigid body are also relatively rigid, with relatively high moduli of elasticity (i.e., Young's modulus). As frequency of the rigid body increases toward and into a resonant frequency range, the connected diaphragm stops moving as a single body, and various portions of the diaphragm move independently and out of phase (e.g., where a first portion moves in an opposite direction to a second portion). FIG. 6 illustrates a waveform suffering from such significant resonant behavior.

According to embodiments of the present invention, the bobbin 42 forms a generally hollow cylindrical shape and includes an axially-forward circumferential edge. The bobbin 42 may be formed from rigid materials, as discussed in more detail below. The bobbin 42 is generally positioned concentric with the central axis 20. The radially-inner edge of the diaphragm 38 is adjacent to the axially-forward edge of the bobbin 42, but is not directly attached to the bobbin 42.

Instead, embodiments of the present invention include an elastic damping ring 54 interposed between the bobbin 42 and the diaphragm 38. The elastic damping ring 54 is used to attach the bobbin 42 to the diaphragm 38. In one or more embodiments, fastening elements or substances such as known glues or adhesives fasten the elastic damping ring 54 respectively to the bobbin 42 and to the diaphragm 38. In one or more embodiments, an elastic damping ring 54 is "interposed" between a bobbin 42 and a diaphragm 38 if it is between the bobbin and the diaphragm along a radial line perpendicular to the central axis 20.

Figure 1:
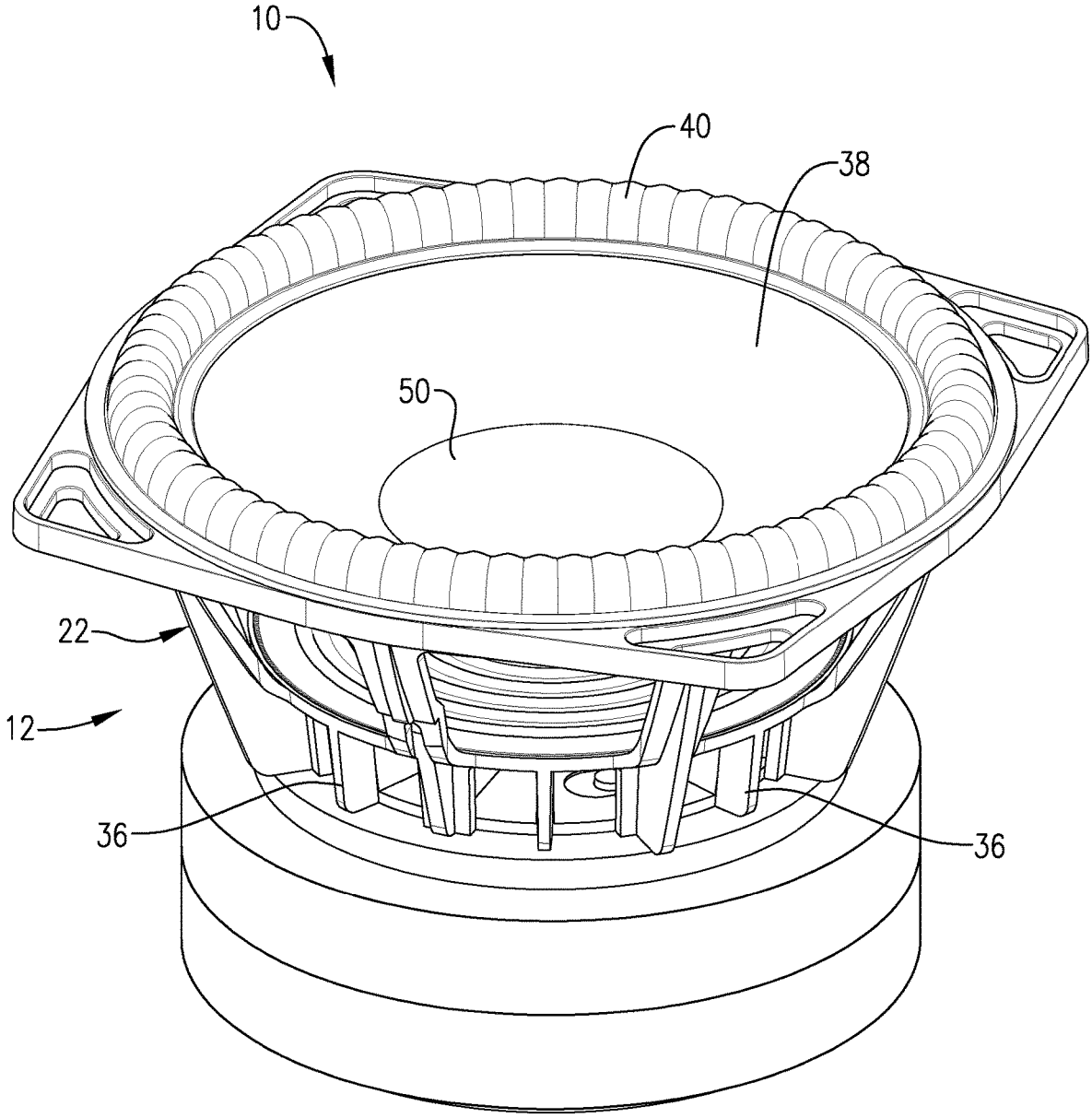
FIG. 1 is an upper perspective view of a loudspeaker constructed in accordance with various embodiments of the invention.
Figure 2:
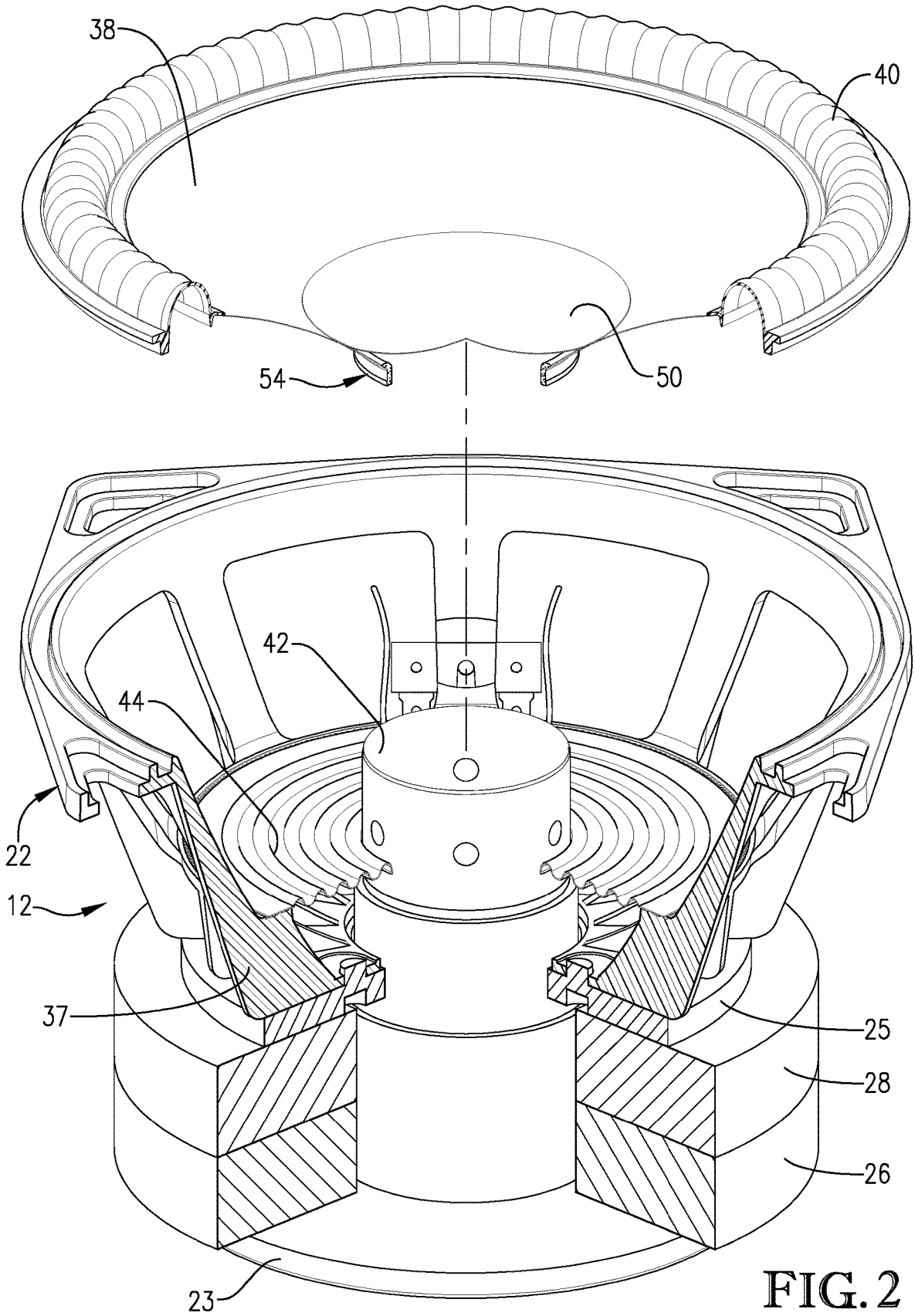
FIG. 2 is a partially exploded and sectioned view of the loudspeaker of FIG. 1, with a diaphragm and other axially forward elements displaced and the axially forward elements and portions of a static structure, magnet and other axially rearward elements (excluding a bobbin, and pole piece) shown with a quarter section removed to reveal interior details of the loudspeaker.
Figure 3:
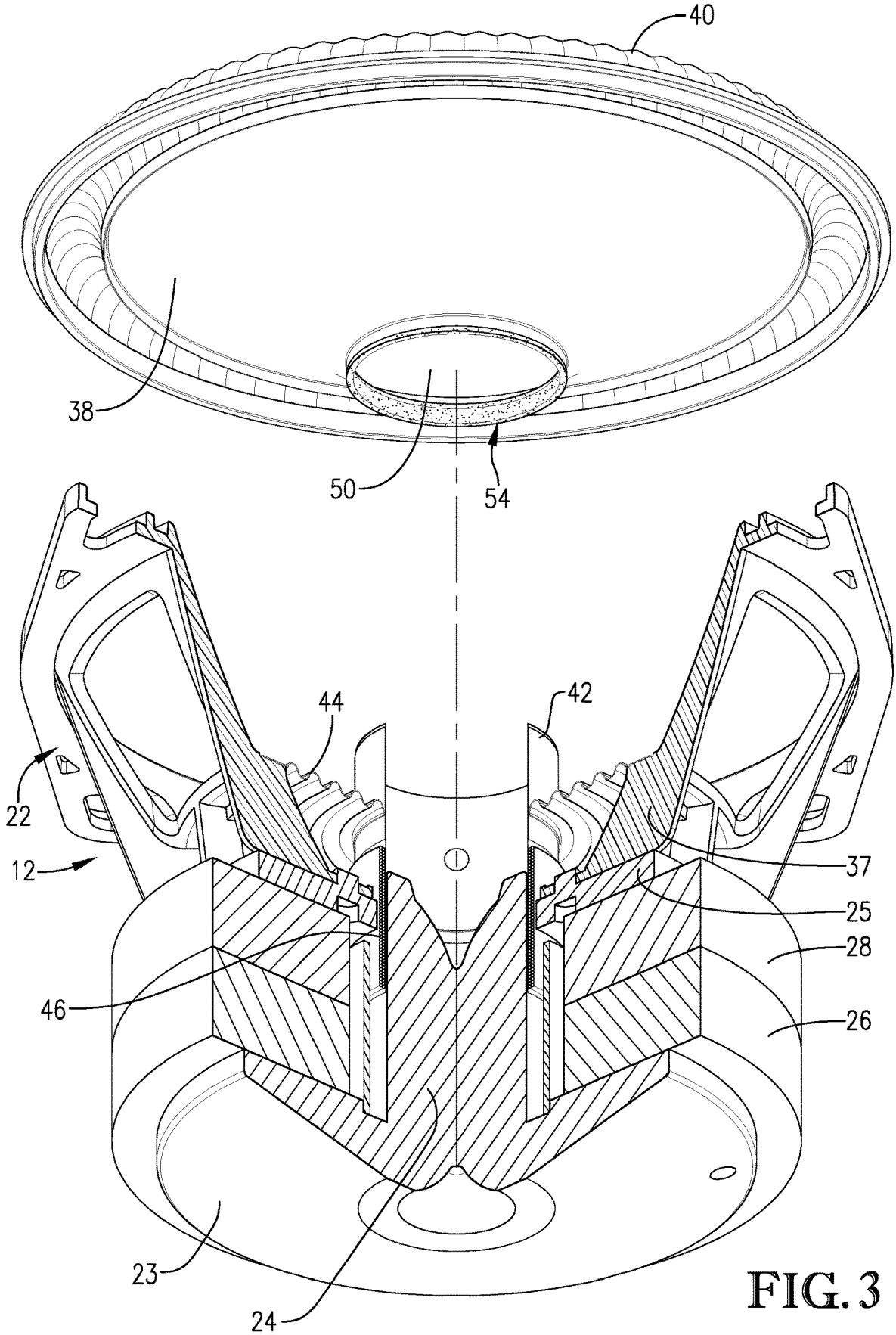
FIG. 3 is a rearwardly-rotated view of the loudspeaker of FIG. 2, with the axially forward elements being shown whole (with the quarter section reconstituted)
Figure 4:
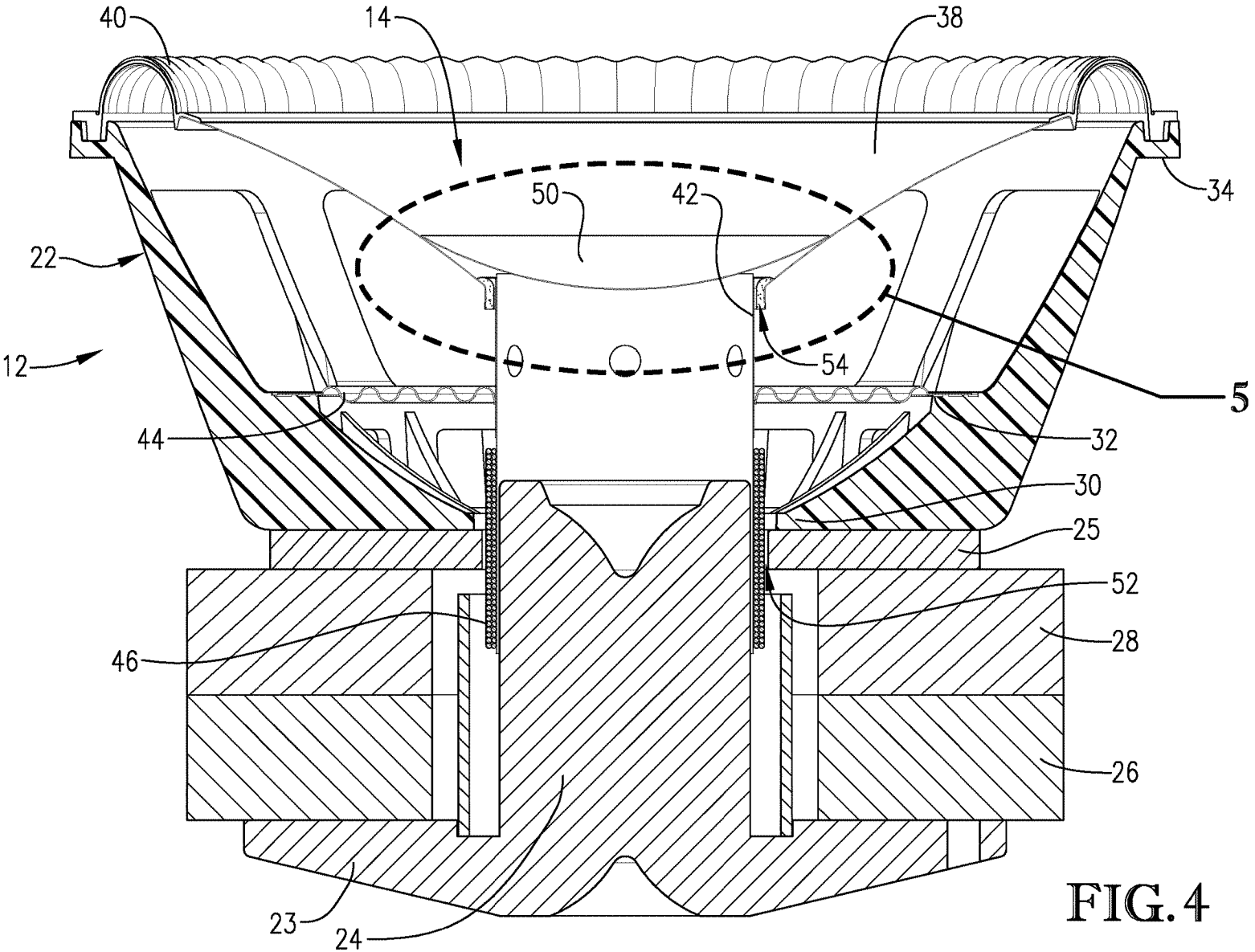
FIG. 4 is a cross-sectional side view of the loudspeaker of FIG. 1, taken through a vertical plane through a central axis of the loudspeaker.
Figure 5:
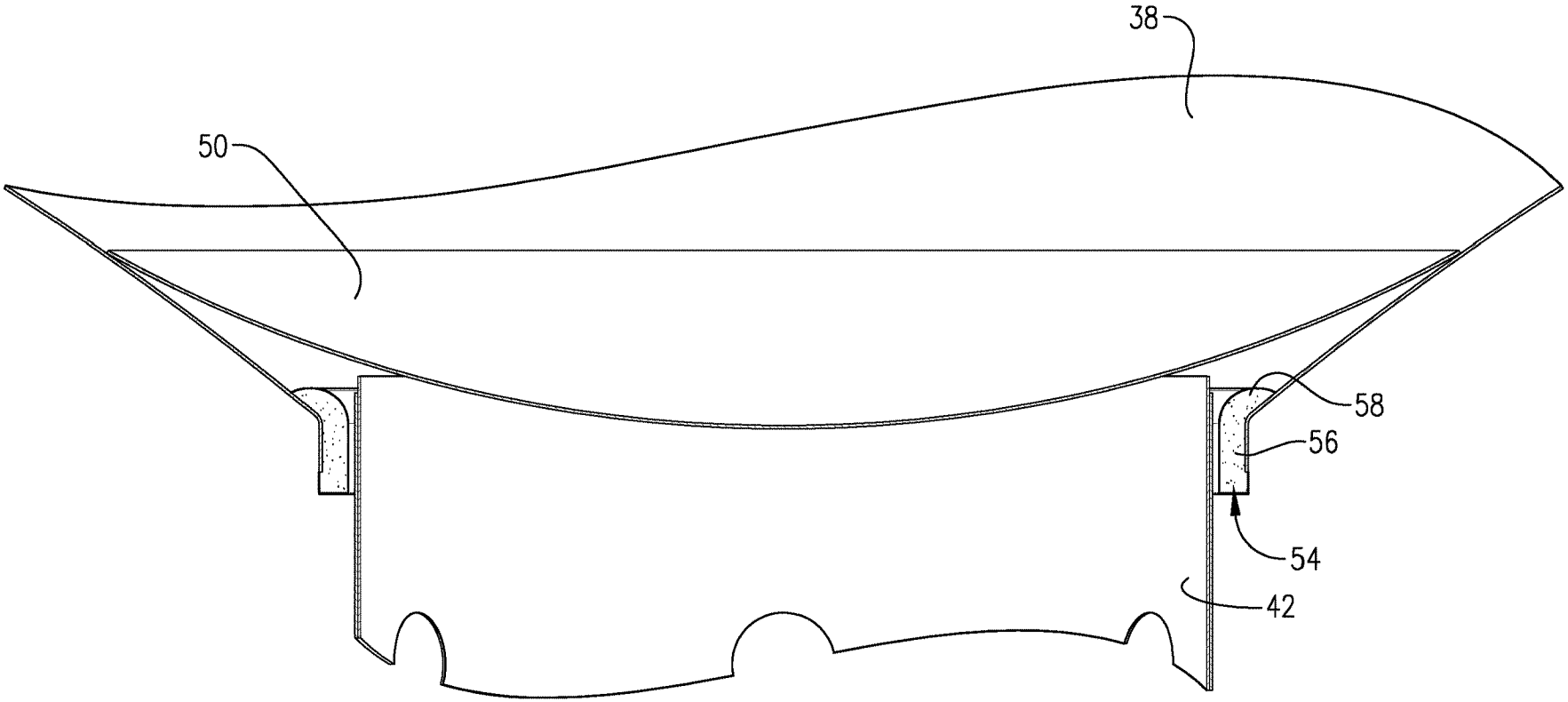
FIG. 5 is a partial detail view of the loudspeaker of FIG. 4, illustrating an elastic damping ring attaching a bobbin to a diaphragm.

Turning to FIG. 5, the elastic damping ring 54 is substantially continuous or continuous, circumscribes the bobbin 42, and includes a main body 56 abutting the bobbin 42 and an axially-forward lip 58. The main body 56 of the elastic damping ring 54 defines an inner circumference and an outer circumference (OC), with a thickness between. Moreover, the bobbin 42 defines an outer circumference (OCB) abutting the elastic damping ring 54. Preferably, the bobbin 42 is secured to the elastic damping ring 54 by fastening elements along at least seventy-five percent (75%) of the OCB. More preferably, the bobbin 42 is secured to the elastic damping ring 54 by fastening elements along at least ninety-five percent (95%) of the OCB. Still more preferably, the bobbin 42 is secured to the elastic damping ring 54 by fastening elements along at least ninety-nine percent (99%) or along one hundred percent (100%) of the OCB. One of ordinary skill will appreciate that the axial length along which the surfaces of the bobbin 42 are secured against those of the elastic damping ring 54 may vary in embodiments of the present invention. Preferably a majority of or substantially all of the axial length of the bobbin 42 abutting the elastic damping ring 54 is secured thereto along secured portions of the OCB.

Further, the diaphragm 38 defines an inner circumference (ICD) abutting and circumscribing the OC of the elastic damping ring 54. Preferably, the ICD of the diaphragm 38 is secured to the elastic damping ring 54 by fastening elements along at least seventy-five percent (75%) of the ICD. More preferably, the diaphragm 38 is secured to the elastic damping ring 54 by fastening elements along at least ninety-five percent (95%) of the ICD. Still more preferably, the diaphragm 38 is secured to the elastic damping ring 54 by fastening elements along at least ninety-nine percent (99%) or along one hundred percent (100%) of the ICD. One of ordinary skill will appreciate that the axial length along which the surfaces of the diaphragm 38 are secured against those of the elastic damping ring 54 may vary across the ICD and between embodiments of the present invention. Preferably a majority of or substantially all of the axial length of the diaphragm 38 abutting the elastic damping ring 54 is secured thereto along secured portions of the ICD.

The elastic damping ring 54 serves as a break in the path of rigid materials beginning with the voice coil 46, traveling up the bobbin 42, through the adhesives and glues and into the diaphragm 38. Existing loudspeakers incorporate only materials having Young's moduli of one thousand megapascals (1,000 MPa) or greater along existing paths, as discussed in more detail below. In contrast, the elastic damping ring 54 of embodiments of the present invention disrupts the rigid path with an elastic component.

The thickness and properties of the material comprising the elastic damping ring 54 are chosen such that, at low frequencies, the elastic damping ring acts as a relatively rigid connection between the bobbin 42 and the diaphragm 38. However, at higher frequencies approaching or including the resonant range(s) of the diaphragm 38, the elastic damping ring 54 effectively becomes relatively soft or rubbery, becoming less efficient in transferring or transmitting the force from the voice coil 46 to the diaphragm 38. Essentially, interposing the elastic damping ring 54 between the bobbin 42 and the diaphragm 38 may act as a mechanical low pass filter.

In one or more embodiments, the elastic damping ring 54 comprises materials exhibiting rubber-like qualities such as rubber, natural rubber, thermopolymer(s) and/or thermo plastic elastomer(s) (TPEs). The modulus of elasticity of the material(s) comprising the elastic damping ring 54 impacts a cut off frequency of the mechanical low pass filter function. The lower the modulus, the lower the frequency at which the elastic damping ring 54 substantially stops transmitting or reduces transmission of the motion of the voice coil 46 into the motion of the diaphragm 38.

In one or more embodiments, the elastic damping ring 54 mostly or entirely comprises materials exhibiting a Young's modulus at least twenty (20) times lower than that of the epoxy, cyanoacrylate or other adhesive that bonds the elastic damping ring 54 to the bobbin 42 and to the diaphragm 38. More preferably, the elastic damping ring 54 mostly or entirely comprises materials exhibiting a Young's modulus at least forty (40) times lower than that of the epoxy, cyanoacrylate or other adhesive that bonds the elastic damping ring 54 to the bobbin 42 and to the diaphragm 38. Still more preferably, the elastic damping ring 54 mostly or entirely comprises materials exhibiting a Young's modulus at least fifty (50) times lower than that of the epoxy, cyanoacrylate or other adhesive that bonds the elastic damping ring 54 to the bobbin 42 and to the diaphragm 38.

It should be noted that Young's modulus and material elasticity comparisons set out herein are taken from the perspective of static material measurements according to established procedures such as, for example, ASTM® E111-17—Standard Test Method for Young's Modulus, Tangent Modulus, and Chord Modulus, as propagated on the priority date of this disclosure.

In one or more embodiments, the elastic damping ring 54 mostly or entirely comprises materials exhibiting a Young's modulus at least eighty (80) times lower than that of the material(s) primarily constituting a non-metallic diaphragm 38. More preferably, the elastic damping ring 54 mostly or entirely comprises materials exhibiting a Young's modulus at least one hundred and twenty (120) times lower than that of the material(s) primarily constituting a non-metallic diaphragm 38. Still more preferably, the elastic damping ring 54 mostly or entirely comprises materials exhibiting a Young's modulus at least one hundred and fifty (150) times lower than that of the material(s) primarily constituting a non-metallic diaphragm 38.

In one or more embodiments, the elastic damping ring 54 mostly or entirely comprises materials exhibiting a Young's modulus at least fifteen hundred (1,500) times lower than that of the material(s) primarily constituting a metallic diaphragm. More preferably, the elastic damping ring 54 mostly or entirely comprises materials exhibiting a Young's modulus at least twenty-five hundred (2,500) times lower than that of the material(s) primarily constituting a metallic diaphragm. Still more preferably, the elastic damping ring 54 mostly or entirely comprises materials exhibiting a Young's modulus at least thirty-five hundred (3,500) times lower than that of the material(s) primarily constituting a metallic diaphragm.

In one or more embodiments, the elastic damping ring 54 mostly or entirely comprises materials exhibiting a Young's modulus at least eighty (80) times lower than that of the material(s), such as plastic, that comprise the rigid main body or majority of the mass of the bobbin 42. More preferably, the elastic damping ring 54 mostly or entirely comprises materials exhibiting a Young's modulus at least one hundred and twenty (120) times lower than that of the material(s) comprising the rigid main body or majority of the mass of the bobbin 42. Still more preferably, the elastic damping ring 54 mostly or entirely comprises materials exhibiting a Young's modulus at least two hundred (200) times lower than that of the material(s) comprising the rigid main body or majority of the mass of the bobbin 42.

In one or more exemplary embodiments, a metal diaphragm may exhibit Young's moduli of: approximately seventy thousand megapascals (70,000 MPa) (aluminum); approximately one hundred and twenty thousand megapascals (120,000 MPa) (titanium); or three hundred thousand megapascals (300,000 MPa) (beryllium). Alternatively, an exemplary non-metallic diaphragm may exhibit a Young's modulus within an approximate range of three thousand to twenty thousand megapascals (3,000-20,000 MPa). Further, the epoxy(ies), cyanoacrylate(s) or other adhesive(s) used to fix the elastic damping ring 54 respectively to the diaphragm 38 and the bobbin 42 may exhibit a Young's modulus within an approximate range of one thousand to six thousand megapascals (1,000-6,000 MPa). Still further, the material(s) comprising the rigid main body or majority of the mass of the bobbin 42 may exhibit a Young's modulus within an approximate range of four thousand to three hundred thousand megapascals (4,000-300,000 MPa). In contrast, embodiments of the present invention provide an elastic damping member primarily or entirely comprising materials exhibiting a Young's modulus of equal to or less than forty megapascals (40 MPa). More preferably, embodiments of the present invention provide an elastic damping member primarily or entirely comprising materials exhibiting a Young's modulus within an approximate range of one to twenty megapascals (1-20 MPa), inclusive.

In embodiments of the present invention, the main body 56 of the elastic damping ring 54 has a substantially constant thickness and inner and outer diameters. In contrast, the tapered lip 58 curls radially outward from the main body 56 and forms an axially-forward end of the elastic damping ring 54. The diaphragm 38 is attached to the elastic damping ring 54 at least in part along the lip 58. The radially outer surface of the lip 58 provides a sealing interface with the diaphragm 38 that is positioned at an additional remove from the bobbin 42. The lip 58 provides for easier assembly i.e., placement and curing of adhesive with attached diaphragm 38 with reduced likelihood that an adhesive bridge will form. An adhesive bridge is a direct attachment between the bobbin 42 and the diaphragm 38 without the interposed elastic damping ring 54 therebetween. Alternatively formulated, an adhesive bridge may be formed where a continuous body of cured adhesive is adhered to both the bobbin 42 and the diaphragm 38. Preferably, no adhesive bridge attachment is formed between the diaphragm 38 and the bobbin 42. It should be noted, however, that the shape of an elastic damping ring may be alternatively conformed, that a lip may be omitted, and/or that the relative proportions of a "main body" and a lip may vary, without departing from the spirit of the present invention.

Further, the thickness and axial height of the elastic damping ring 54 may be optimized. For example, the optimal thickness and axial height of the elastic damping ring 54 is directly related to the frequency of the low pass mechanical filter functionality of embodiments of the present invention. Further, the axial height may impact the bonding strength between the elastic damping ring 54 and, respectively, the diaphragm 38 and the bobbin 42. Still further, the mass of the elastic damping ring 54 is also preferably minimized while tuning the low pass filter functionality to the frequency or frequency range in question.

In one or more embodiments, the thickness of the main body 56 may range between two tenths of a millimeter (0.2 mm) and three millimeters (3 mm), inclusive. The thickness may depend at least in part on the characteristics (e.g., size) of the diaphragm 38 and the frequency or frequency range in question. Further, in one or more embodiments, the axial height of the elastic damping ring 54 may range between one millimeter (1 mm) and ten millimeters (10 mm), inclusive.

FIGS. 6-8 contrast the behavior of diaphragms at resonant frequencies respectively with and without an elastic damping ring of embodiments of the present invention. For example, FIG. 7 demonstrates a reduced amplitude of resonance in embodiments of the present invention incorporating an elastic damping ring. More particularly, FIG. 7 contrasts a resting diaphragm (forming a gentle arc) with a diaphragm in its resonance range that displays a low-amplitude waveform.

FIG. 6, on the other hand, illustrates response of a loudspeaker lacking the elastic damping ring of embodiments of the present invention, with a resting diaphragm (forming a gentle arc) and a diaphragm in its resonance range displaying a high-amplitude waveform.

Moreover, experimental results shown in FIG. 8 demonstrate significant mitigation of resonant behavior in the range of between about four kilohertz (4 kHz) to about seven kilohertz (7 kHz) in embodiments incorporating mitigation via the elastic damping ring. More particularly, the unmitigated wave form includes frequency response with a fifteen decibel (15 dB) resonance peak at five and eight tenths kilohertz (5.8 kHz), whereas the peak is essentially eliminated by mitigation via the elastic damping ring according to embodiments of the present invention. It should also be noted that elastic damping rings according to embodiments of the present invention advantageously improve sound quality and simplify crossover design, resulting in fewer components and less assembly labor.

ADDITIONAL CONSIDERATIONS

Throughout this specification, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current invention can include a variety of combinations and/or integrations of the embodiments described herein.

Although the present application sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the technology has been described with reference to the embodiments illustrated in the attached drawing figures, it is noted that equivalents may be employed and substitutions made herein without departing from the scope of the technology as recited in the claims.

Having thus described various embodiments of the technology, what is claimed as new and desired to be protected by Letters Patent includes the following:

1. A loudspeaker driver moving system comprising:
a bobbin;
a diaphragm; and
an elastic damping ring interposed between and directly attached respectively to the bobbin and the diaphragm, the elastic damping ring comprising materials exhibiting a Young's modulus of equal to or less than forty megapascals (40 MPa).

2. The loudspeaker driver moving system of claim 1—
the elastic damping ring circumscribing an outer circumference of the bobbin,
the diaphragm circumscribing an outer circumference of the elastic damping ring.

3. The loudspeaker driver moving system of claim 2—
the elastic damping ring being fixed to the outer circumference of the bobbin along at least seventy-five percent (75%) of the outer circumference of the bobbin,
the diaphragm being fixed to the outer circumference of the elastic damping ring along at least seventy-five percent (75%) of the outer circumference of the elastic damping ring.

4. The loudspeaker driver moving system of claim 3—
the elastic damping ring being fixed to the outer circumference of the bobbin along at least ninety-nine percent (99%) of the outer circumference of the bobbin,
the diaphragm being fixed to the outer circumference of the elastic damping ring along at least ninety-nine percent (99%) of the outer circumference of the elastic damping ring.

5. The loudspeaker driver moving system of claim 3—
the elastic damping ring being fixed to the bobbin and the diaphragm using one or more adhesives.

6. The loudspeaker driver moving system of claim 3—
the bobbin being configured to oscillate along a central axis of a static structure attached to the diaphragm,
the elastic damping ring being interposed between the bobbin and the diaphragm along a radial line perpendicular to the central axis.

7. The loudspeaker driver moving system of claim 1—
the elastic damping ring including a main body abutting the bobbin, the main body being between two tenths of a millimeter (0.2 mm) and three millimeters (3 mm) thick, inclusive.

8. The loudspeaker driver moving system of claim 7—
the bobbin being configured to oscillate along a central axis of a static structure attached to the diaphragm,
the main body having an axial height between one millimeter (1 mm) and ten millimeters (10 mm), inclusive.

9. The loudspeaker driver moving system of claim 1—
the bobbin being configured to oscillate along a central axis of a static structure attached to the diaphragm,
the elastic damping ring including a main body abutting the bobbin and a tapered lip curling radially outward from an axially-forward end of the main body.

10. The loudspeaker driver moving system of claim 9—
the diaphragm being at least partly attached to the elastic damping ring along the tapered lip.

11. The loudspeaker driver moving system of claim 1—
wherein no adhesive bridge attachment is formed between the diaphragm and the bobbin.

12. The loudspeaker driver moving system of claim 1—
the diaphragm being formed primarily from one or more materials selected from the group consisting of: paper, polypropylene, Mylar, aluminum, titanium, beryllium, magnesium, and any combination of the foregoing,
the bobbin being primarily formed from plastic,
the elastic damping ring primarily comprising materials exhibiting a Young's modulus below twenty megapascals (20 MPa).

13. The loudspeaker driver moving system of claim 12—
the material(s) primarily comprising the elastic damping ring being one or more materials selected from among the group consisting of: rubber, natural rubber, thermopolymers and thermo plastic elastomers.

14. The loudspeaker driver moving system of claim 12—
the material(s) primarily comprising the diaphragm exhibiting a Young's modulus of at least three thousand megapascals (3,000 MPa),
the plastic of the bobbin exhibiting a Young's modulus of at least four thousand megapascals (3,000 MPa).

15. The loudspeaker driver moving system of claim 14—
the diaphragm and the bobbin being respectively attached to the elastic damping ring via one or more adhesive(s), the one or more adhesive(s) exhibiting a Young's modulus of at least one thousand megapascals (1,000 MPa).

16. The loudspeaker driver moving system of claim 1—the diaphragm and the bobbin being respectively attached to the elastic damping ring via one or more adhesive(s), the one or more adhesive(s) exhibiting a Young's modulus at least twenty (20) times greater than that of material(s) primarily comprising the elastic damping ring.

17. The loudspeaker driver moving system of claim 1—material(s) primarily comprising the diaphragm exhibiting a Young's modulus at least eighty (80) times greater than that of material(s) primarily comprising the elastic damping ring.

18. The loudspeaker driver moving system of claim 1—material(s) primarily comprising the bobbin exhibiting a Young's modulus at least eighty (80) times greater than that of material(s) primarily comprising the elastic damping ring.

* * * * *